US011596229B2

(12) United States Patent
Howell

(10) Patent No.: US 11,596,229 B2
(45) Date of Patent: Mar. 7, 2023

(54) FURNITURE SPACER

(71) Applicant: Steven Howell, Factoryville, PA (US)

(72) Inventor: Steven Howell, Factoryville, PA (US)

(73) Assignee: Steven Howell, Factoryville, PA (US)

( * ) Notice: Subject to any disclaimer, the term of this patent is extended or adjusted under 35 U.S.C. 154(b) by 0 days.

(21) Appl. No.: 17/327,058

(22) Filed: May 21, 2021

(65) Prior Publication Data

US 2021/0361069 A1 Nov. 25, 2021

Related U.S. Application Data

(60) Provisional application No. 63/028,969, filed on May 22, 2020.

(51) Int. Cl.
*A47B 95/04* (2006.01)
*A47B 97/00* (2006.01)

(52) U.S. Cl.
CPC ..... *A47B 95/043* (2013.01); *A47B 97/00* (2013.01); *A47B 2220/0061* (2013.01)

(58) Field of Classification Search
CPC . A47B 95/043; A47B 91/12; A47B 2097/008; A47B 2220/0061; A47B 95/00; A47B 95/04; A47B 2095/046; A47B 97/00; A47C 7/62
USPC ..... 248/345.1, 501; D8/402, 403
See application file for complete search history.

(56) References Cited

U.S. PATENT DOCUMENTS 184,729 A * 11/1876 Rouse ..... A47B 95/043 248/345.1
2,018,264 A * 10/1935 Jones ..... A47B 91/12 248/346.11
3,191,811 A * 6/1965 McBroom ..... B65D 81/36 215/390
D257,761 S * 1/1981 Abel ..... A47B 95/00 D8/355
D336,424 S * 6/1993 Barber ..... D8/402
5,482,491 A * 1/1996 Kichijyo ..... A63H 33/08 446/124
5,794,545 A * 8/1998 McDaniel ..... A47B 13/021 248/188
5,799,921 A * 9/1998 Stattel ..... A47B 97/00 248/501
5,803,423 A * 9/1998 Harrell ..... A47B 97/00 248/345.1
6,530,803 B1 * 3/2003 Chen ..... H01R 13/5837 439/465
6,578,232 B2 * 6/2003 Salice ..... E05D 7/0407 248/501

(Continued)

*Primary Examiner* — Jonathan Liu
*Assistant Examiner* — Guang H Guan
(74) *Attorney, Agent, or Firm* — Volpe Koenig

(57) ABSTRACT

A furniture spacer having a rigid flat construction is configured to rest on the floor between the base of a wall and a piece of furniture such as a chair, sofa, table, or cabinet and the like to keep the furniture away from the wall and prevent it from hitting the wall or window and causing damage. Since furniture comes in many sizes and shapes, with different degrees of lean from the leg bottom to the most rearward part of the furniture it is desirable that a single such spacer accommodate a wide variety of furniture designs, including legs within a reasonable range of widths and shapes, which the particular shape of the described spacer is able to do without significant effort on the part of the user.

5 Claims, 2 Drawing Sheets

(56) References Cited

U.S. PATENT DOCUMENTS

| | | | | | |
|---|---|---|---|---|---|
| D503,864 | S * | 4/2005 | DiFanti | A47C 7/62 | D8/402 |
| 8,061,676 | B1 * | 11/2011 | Kumar | A47C 7/62 | 248/500 |
| 8,356,788 | B2 * | 1/2013 | Drew | A47B 95/043 | 428/122 |
| 8,424,828 | B1 * | 4/2013 | Roccasalva | A47B 95/00 | 248/346.11 |
| D723,852 | S * | 3/2015 | Martin | A47C 3/04 | D6/717 |
| 9,717,336 | B1 * | 8/2017 | Apple | A47C 3/04 | |
| 10,407,240 | B2 * | 9/2019 | Howell | B65F 1/1646 | |
| 10,881,205 | B2 * | 1/2021 | Angel | A47B 91/08 | |
| 2021/0361069 | A1 * | 11/2021 | Howell | A47C 7/002 | |

* cited by examiner

FURNITURE SPACER

CROSS REFERENCE TO RELATED APPLICATIONS

This non-provisional patent application claims the benefit under 35 U.S.C. § 119(e) of provisional application No. 63/028,969 filed May 22, 2020 and entitled Furniture Spacer. The entire disclosure of the provisional application is incorporated herein by reference.

BACKGROUND

Most pieces of furniture, while relatively heavy, will still shift around somewhat under daily use, for example as users flop down onto a sofa, or trip against a table, shift in a chair, or open and close drawers. Household pets and children can even shift furniture as they run around and jump upon it. Depending on the position, this could cause a table to tip, the back of a sofa or chair to scrape against a wall and damage its surface, or even (when the furniture is placed against a wall which has a large window) to cause the edge of such furniture to shatter the glass. Even if the surface against which the furniture rests is not damaged, it may still slide around from its original position on the floor, depending on the smoothness of the floor and the furniture legs or bottom. Devices to hold the furniture in its designated position are thus desirable.

DETAILED DESCRIPTION OF PREFERRED EMBODIMENTS

Those skilled in the art will recognize other detailed designs and methods that can be developed employing the teachings of the present invention. The examples provided here are illustrative and do not limit the scope of the invention, which is defined by the attached claims. The following detailed description refers to the accompanying drawings. The same reference numbers in different drawings may identify the same or similar elements.

Figure 1:
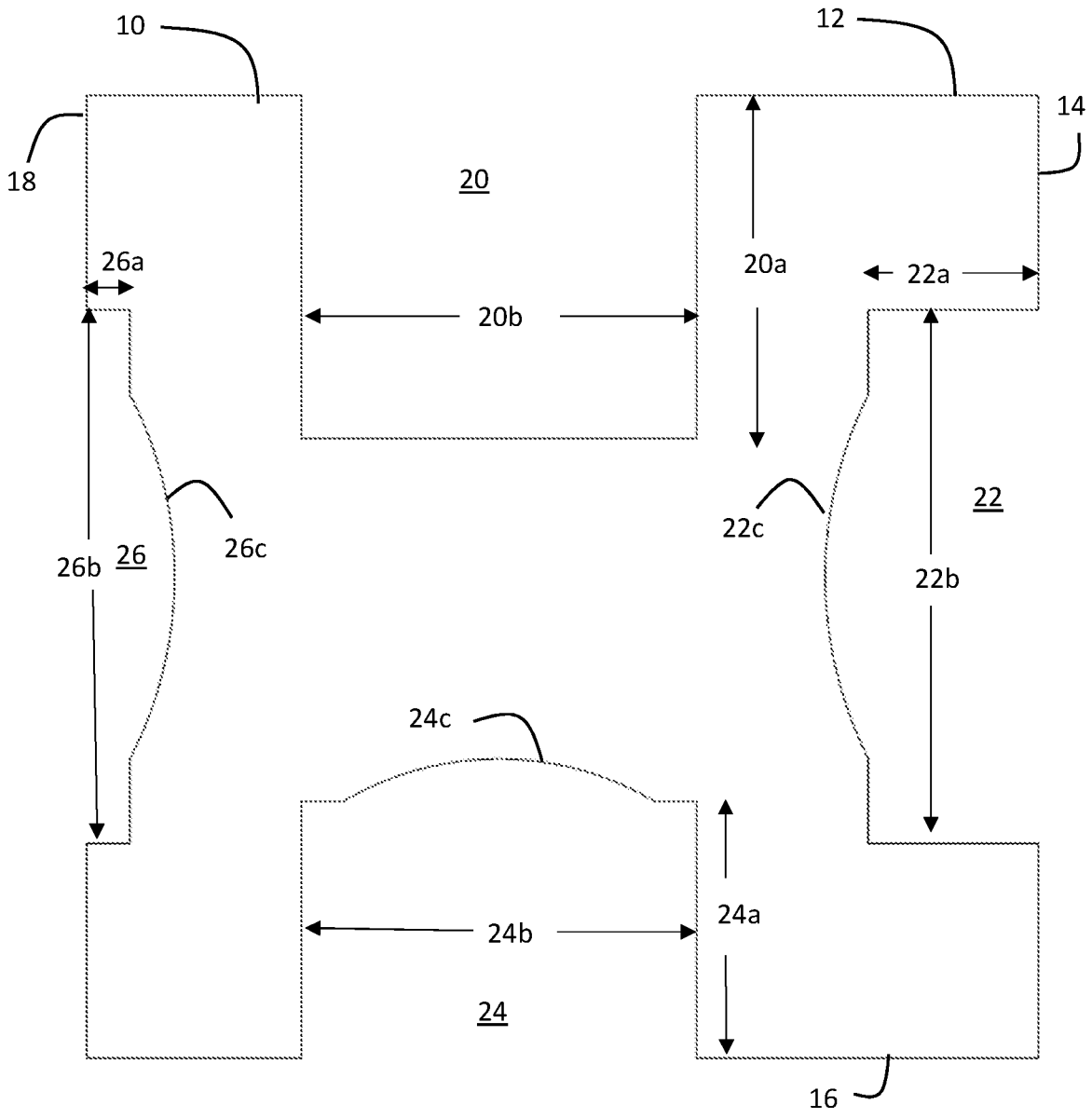
FIG. 1 is a drawing of an exemplary furniture spacer.

According to an aspect of the invention, a multi-sided furniture spacer is provided comprising a rigid or semi-rigid piece of relatively thin flat material or plate (plastic, wood, rubber, metal, thick cardboard, etc.) configured to rest on the floor between the leg of a piece of furniture and the wall or baseboard or other molding at the bottom of a wall. As shown in FIG. 1, an exemplary four-sided spacer 10 having four sides 12, 14, 16, and 18, and four different depth openings (slots) 20, 22, 24, 26 formed in respective sides 12, 14, 16, and 18 to both capture the leg of the piece of furniture and hold it in place as well as allow the user to rotate the spacer and put the leg of the furniture into the opening with the correct depth to the wall to keep the piece of furniture from contacting it. Consistent with embodiments described herein, openings 20-26 may be rectangular 20 or rectangular with an arcuate relief at the inside edge of the rectangle (22, 24, 26). As shown in FIG. 1, spacings between openings 20-26 and their opposing sides may have different values for establishing different offsets between the furniture piece and the wall to which it is adjacent. As an example, the distance between an inside of opening 20 and side 16 may be different than the distance between an inside of opening 24 and side 12.

Accordingly, in one use configuration, the spacer 10 can be placed with side 16 against a wall and a furniture leg inserted in opening 20, which opposes side 16. For a different leg to wall distance, the spacer 10 can be placed with side 14 against the wall and the furniture leg placed in the slot 26. Openings 22, 24 and 26 include inside edges having arcuate portions to accommodate round furniture legs while also having straight portions to accommodate square or rectangular furniture legs.

Figure 2:
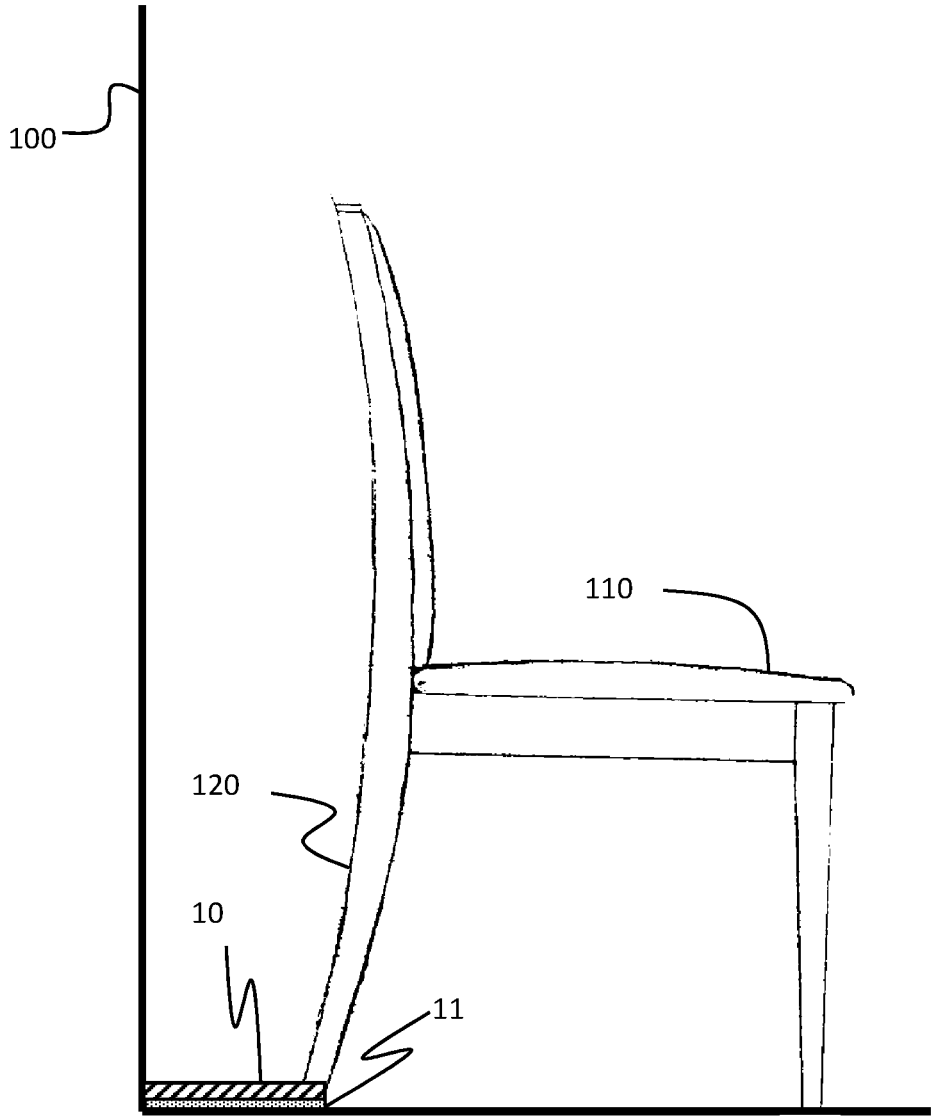
FIG. 2 is a drawing of the furniture spacer of FIG. 1 in use with a chair.

FIG. 2 shows the exemplary spacer 10 of FIG. 1 in use with a chair 110 to separate the chair leg 120 a predetermined distance from the wall 100.

FIG. 1 shows a top view of a flat universal furniture spacer. The dimensions and shape are designed to yield a compact spacer able to be cut from inexpensive 1"×6" or 2"×6" dimensional lumber or sheet plastic that will still be sufficiently universal to work with square and round furniture legs and with furniture of different back or arm lean or tabletop or edge overhangs. While this size is believed to fit most furniture, these dimensions can be scaled up proportionally to create an even larger version to deal with oversize furniture which requires wider leg openings or larger leg to wall distances, or smaller to deal with especially small furniture or to become even more unobtrusive. A spacer thickness of ½" to 1" would normally be sufficient, but for furniture in heavy use, a thickness of 1.5" or even more might be helpful to prevent the furniture leg from jumping vertically out of its place in the spacer. Conveniently, the design loosely resembles the outline of a household pet with legs, head and tail, potentially contributing to its acceptance and appropriateness for the residential household. This pet-like appearance may be enhanced with appropriate artwork on the top surface of the spacer.

In an exemplary embodiment the four-sided spacer of FIG. 1 has one slot 20 that is rectangular with a depth 20*a* and width 20*b*. A second slot 22 is rectangular with a depth 22*a* and a width 22*b*. The rectangular slot 22 further has as an arcuate inside edge 22*c*. The arcuate portion 22*c* is a portion of a circle. A third slot 24 is rectangular with a depth 24*a* and a width 24*b*. The rectangular slot 24 further has an arcuate inside edge 24*c*. The arcuate portion 24*c* is a portion of a circle. A fourth slot 26 is rectangular with a depth 26*a* and a width 26*b*. The rectangular slot 26 further has as an arcuate inside edge 26*c*. The arcuate portion 26*c* is a portion of a circle. Each of the four slots 20, 22, 24, and 26 may be centered along their respective sides 12, 14, 16 and 18 or offset from center as shown in FIG. 1.

According to an aspect of the invention, the spacer 10 of FIG. 1, sides 12, 14, 16, and 18 are each approximately 5.5 inches long. Slot 20 has a depth of 2 inches and a width of 2.3 inches. Slot 22 has a depth of 1 inch and a width of 3.1 inches. The arc 22*c* is a portion of a circle having a radius of 2.4 inches. Slot 24 has a depth of 1.5 inches and a width of 2.3 inches. The arc 24*c* is a portion of a circle having a radius of 1.8 inches. Slot 26 has a depth of 0.25 inches and a width of 3.1 inches. The arc 26*c* is a portion of a circle having a radius of 2.3 inches. All dimensions are +/−0.1 inch.

Based on field testing, the above-dimensioned space size and openings are fit a wide variety of furniture legs and accommodate a wide variety of sofa lean-backs or tabletop overhang still keeping the furniture from contacting a wall. There is a provision for accommodating both square and round furniture legs as well, within the same leg opening.

Construction of the spacer from residential or office-friendly unobtrusive materials, such as wood, colored plastic, rubber, painted metal, as noted above, will help it to be unobtrusive against the decorative flooring of the home or office, and be effectively unnoticeable if colored, painted, stained or otherwise finished to be well-matched to the flooring.

Since the spacer itself has a fairly large surface area, it will tend to hold furniture in place better due to friction against the floor and wall baseboard than furniture legs alone, allowing it to function both to help anchor furniture in place laterally as well as space it away from the wall. This stabilization function can be improved by either making the spacer from a high-friction slip resistant material (such as rubber) or coating the bottom and/or wall-facing sides of the spacer (made from inexpensive wood or plastic, perhaps) with a thin layer of rubber-like material 11. For industrial use in keeping industrial furniture or equipment in place and away from the wall, thicker rubber construction or facing of the spacer may even help to dampen equipment vibrations and prevent transmission of them to factory or warehouse walls. The spacer may be colored differently on each of its two faces to allow for blending into two different floor colors.

In testing, a spacer thickness of 0.5 inch is sufficient to hold normal residential furniture in place. Where furniture may have a tendency to be knocked vertically out of the opening of the relatively 0.5 inch spacer, such as under heavy or athletic use or the jumping around of children or pets on furniture, thicker versions of the spacer can be inexpensively constructed from thicker material, such as dimensional wooden planks (1.5" nominal thickness) or even thicker material. In addition, for those exceptional pieces of furniture which have unusual amounts of back or arm lean or top overhang which would require even more of a gap between the furniture leg and the wall, or furniture which has exceptionally thick legs, the above-described exemplary dimensions of the spacer can be linearly scaled up to a larger version with larger dimensions and wider leg openings.

Although the invention has been described in detail above, it is expressly understood that it will be apparent to persons skilled in the relevant art that the invention may be modified without departing from the spirit of the invention. Various changes of form, design, or arrangement may be made to the invention without departing from the spirit and scope of the invention. For example, the spacer may have more or less sides than four, some or all of which may have slots. The sides may be of unequal length. Some or all of the slots may be rectangular or rectangular with arcuate portions of edges. Therefore, the above-mentioned description is to be considered exemplary, rather than limiting, and the true scope of the invention is that defined in the following claims.

No element, act, or instruction used in the description of the present application should be construed as critical or essential to the invention unless explicitly described as such. Also, as used herein, the article "a" is intended to include one or more items. Further, the phrase "based on" is intended to mean "based, at least in part, on" unless explicitly stated otherwise.

What is claimed is:

1. A furniture spacer for spacing a furniture leg a predetermined distance from a wall, the furniture spacer comprising:

a top surface, a bottom surface, a slip-resistant layer on said bottom surface, a first side having a first opening, said first opening comprising a first rectangular shape with a first arcuate relief located on a first inside edge of said first opening, a second side having a second opening, said second opening comprising a second rectangular shape with a second arcuate relief located on a second inside edge of said second opening, a third side having a third opening, said third opening comprising a third rectangular shape with a third arcuate relief located on a third inside edge of said third opening, a fourth side having a fourth rectangular opening, an intersection between said first side and said second side forming a 90-degree angle, an intersection between said second side and said third side forming a 90-degree angle, an intersection between said third side and said fourth side forming a 90-degree angle, an intersection between said fourth side and said first side forming a 90-degree angle, said first opening being centered with respect to said first side, said second opening being offset with respect to a center of said second side, said third opening being centered with respect to said third side, and said fourth rectangular opening being offset with respect to a center of said fourth side, wherein each of said first, second and third openings is configured to receive a furniture leg having a round cross-section or a rectangular cross-section, and said fourth rectangular opening is configured to receive a furniture leg having a rectangular cross-section.

2. The furniture spacer of claim 1, wherein said first side, said second side, said third side and said fourth side are each of equal length of approximately 5.5 inches.

3. The furniture spacer of claim 2, wherein said first opening has a depth of approximately, 1 inch and a width of approximately 3.1 inches, and said first arcuate relief has a radius of approximately 2.4 inches, said second opening has a depth of approximately 1.5 inches and a width of approximately 2.3 inches, and said second arcuate relief has a radius of approximately 1.8 inches, said third opening has a depth of approximately 0.25 inches and a width of approximately 3.1 inches, and said third arcuate relief has a radius of approximately 2.3 inches, and said fourth rectangular opening has a depth of approximately 2 inches and a width of approximately 2.3 inches.

4. The furniture spacer of claim 3, wherein the furniture spacer has a thickness of between approximately 0.5 inches and 1.5 inches.

5. The furniture spacer of claim 1, wherein said slip-resistant layer comprises rubber.

* * * * *